US005874716A

United States Patent [19]

Park et al.

[11] Patent Number: 5,874,716

[45] Date of Patent: Feb. 23, 1999

[54] MICROWAVE OVEN HAVING A COVER PLATE FOR SEALING AN OPENING FORMED IN A PANEL SEPARATING A COOKING CHAMBER FROM AN ELECTRICAL COMPONENTS CHAMBER

[75] Inventors: Myoung-Hwan Park, Suwon; Jung-Hee Lee, Uiwang, both of Rep. of Korea

[73] Assignee: Samsung Electronics Co., Ltd., Suwon, Rep. of Korea

[21] Appl. No.: 912,984

[22] Filed: Aug. 12, 1997

[30] Foreign Application Priority Data

Dec. 12, 1996 [KR] Rep. of Korea ..... 96-64833
May 21, 1997 [KR] Rep. of Korea ..... 9719728

[51] Int. Cl.[6] ..... H05B 6/70

[52] U.S. Cl. ..... 219/746; 219/756

[58] Field of Search ..... 219/746, 748, 219/749, 743, 756; 333/252

[56] References Cited

U.S. PATENT DOCUMENTS 4,160,576 7/1979 Vettori ..... 439/191
4,733,037 3/1988 Nitta et al. ..... 219/746
4,868,359 9/1989 Iwabuchi et al. ..... 219/743
5,371,343 12/1994 Yoshimura et al. ..... 219/746

FOREIGN PATENT DOCUMENTS 5-26459 2/1993 Japan ..... 219/743
6-111935 4/1994 Japan ..... 219/751

*Primary Examiner*—Philip H. Leung
*Attorney, Agent, or Firm*—Burns, Doane, Swecker & Mathis, L.L.P.

[57] ABSTRACT

A microwave oven is disclosed, in which the edges of the opening between the cooking chamber and electrical component compartment are bent, thereby strengthening the side panel on which the opening is formed and also forming half of a joining means which connects a cover plate to the opening. The cover plate includes hooked catches(the other half of the joining means) and flexible sealing members that lie flush against the side panel when the cover plate is installed. The elasticity of these sealing members allows them to maintain a tight seal even if the shape of the side panel becomes distorted during the assembly of the microwave.

2 Claims, 5 Drawing Sheets

MICROWAVE OVEN HAVING A COVER PLATE FOR SEALING AN OPENING FORMED IN A PANEL SEPARATING A COOKING CHAMBER FROM AN ELECTRICAL COMPONENTS CHAMBER

BACKGROUND OF THE INVENTION (1) Field of the Invention

The present invention generally relates to a microwave oven. More particularly, it relates to a microwave oven which includes an opening, formed on one side panel of the microwave oven's inner case, through which high frequency energy produced by a magnetron is introduced into a cooking chamber, and a cover plate for sealing the opening to prevent dirt and dust from getting into the cooking chamber, pervious to the high frequency energy.

(2) Description of the Prior Art

A microwave oven is a cooking appliance that cooks food by frictional heat generated by making the molecules of the food being cooked move at high speeds with the use of high frequency energy. FIG. 4 is a sectional view of the interior construction of a conventional microwave oven.

As shown in FIG. 4, the conventional microwave oven includes an inner case 20 in which a cooking chamber 30 is formed, and an outer case 10. The inner case 20 has a front panel 21, a rear panel 22 and right and left side panels 23, thus constituting the cooking chamber 30. Also, there is a tray 31 at the bottom of the cooking chamber 30 and an opening in the front panel 21 of the cooking chamber 30. The outer case 10 is connected to the ends of the front panel 21 and the rear panel 22 of the inner case 20, thus constituting the main body of the microwave oven. This outer case 10 is spaced away from the side panels 23 of the inner case 20. A door 50 is hinged on one side of the front panel 21 of the inner case 20 to open and close the cooking chamber 30, and a control portion 51 is provided to the right side of the front panel 21.

An electrical component compartment 40, in which various electrical components are installed, is provided in the space between the right side panel 23 of the inner case 20 and the right side panel 11 of the outer case 10. In the electrical component compartment 40 are mounted a magnetron 42 for producing high frequency energy to the cooking chamber 30, and a fan 41 for cooling off the electrical components that emit heat during operation.

The magnetron 42 is connected to the right side panel 23 of the inner case 20, facing the electrical component compartment 40, and an opening 23*c* is formed on the right side panel 23 through which high frequency waves enter the cooking chamber 30. A cover plate 60 comes in contact with the right side panel 23 to cover the opening 23*c* inside of the cooking chamber 30. More specifically, as shown in FIG. 5, the cover plate 60 is coupled to the right side panel 23 by the use of a curved portion 61 and an elastic piece 62, and this coupling structure is now described in detail.

As shown in the drawing, the opening 23*c* is positioned on the middle of the right side panel 23 to allow the electrical component compartment 40 to communicate with the cooking chamber 30, and holes 23*a* and 23*b* are respectively formed on the lower and upper sides of the opening 23*c*. The magnetron 42 is installed on the right side panel 23 in the electrical component compartment 40, and emits the high frequency waves to the cooking chamber 30 through the opening 23*c*. The curved portion 61 and the elastic piece 62 are respectively formed on the lower and upper sides of the cover plate 60's back to mate with the holes 23*a* and 23*b*. As the elastic piece 62 is placed into the hole 23*b* after the curved portion 61 has been fitted into the hole 23*a*, the front ends of the hook 61 and the elastic piece 62 come in close contact with the right side panel 23 on the side of the electrical component compartment 40, thus securely fixing the cover plate 60 onto the right side panel 23. Also, the edges of the cover plate 60 are beveled. The microwaves produced by the magnetron 42 are furnished to the cooking chamber 30 through the opening 23*c* and the cover plate 60, and the cover plate 60 keeps the dirt and dust from sticking to the magnetron 42.

In such a conventional microwave oven, the right side panel 23 may be deformed in the process of welding the magnetron 42 onto the right side panel 23 or when the curved portion 61 and the elastic piece 62 are respectively inserted into the holes 23*a* and 23*b* during coupling of the cover plate 60. Once the right side panel 23 gets distorted, the cover plate 60 may not lie flush on the side panel, thereby creating a gap between the cover plate 60 and the side panel 23 in which dirt and dust can collect. The dirt and dust in the gap cause an electric spark that decreases the reliability of the microwave oven thereby.

SUMMARY OF THE INVENTION

The present invention is a microwave oven that can obviate the defects and disadvantages of the conventional technique.

It is an objective of the present invention to provide a microwave oven which has an opening, formed on the right side panel of the microwave oven's cooking chamber, through which microwave energy is introduced into the cooking chamber, and curved portion, protruding into the electrical component compartment along the edges of the opening, thereby preventing the right side panel from getting out of its shape when a cover plate is coupled to the right side panel to cover the opening.

It is another objective of the present invention to provide a microwave oven having flexible sealing members provided to the edges of the cover plate for covering the opening, and whose tips stick to the cooking chamber's right side panel when the cover plate is joined to the right side panel, thus precluding the formation of a gap between the cover plate and the right side panel.

In order to obtain the above-mentioned objectives of the present invention, there is disclosed a microwave oven including an inner case with a cooking chamber; an outer case connected with the inner case, spaced away from the inner case, and having an electrical component compartment separated from the cooking chamber; a side panel defining the cooking chamber with an opening to allow the cooking chamber to communicate with the electrical component compartment; and a magnetron mounted on the side panel in the electrical component compartment to generate microwave energy to be sent to the cooking chamber through the opening; a cover plate joined to the side panel, thus covering the opening.

The inventive microwave oven also includes curved portions that are formed on the upper and lower edges of the opening and protrude towards the electrical component compartment; and catches formed on the back of the cover plate to catch the curved portions as they pass through the opening, whereby the cover plate is joined to the side panel. A hook is formed into an outward curve on the tips of the catches for catching the curved portions. Flexible sealing members are provided to edges of the cover plate, thus coming in close contact with the side panel when joining the cover plate to the side panel.

DETAILED DESCRIPTION OF PREFERRED EMBODIMENTS

Figure 1:
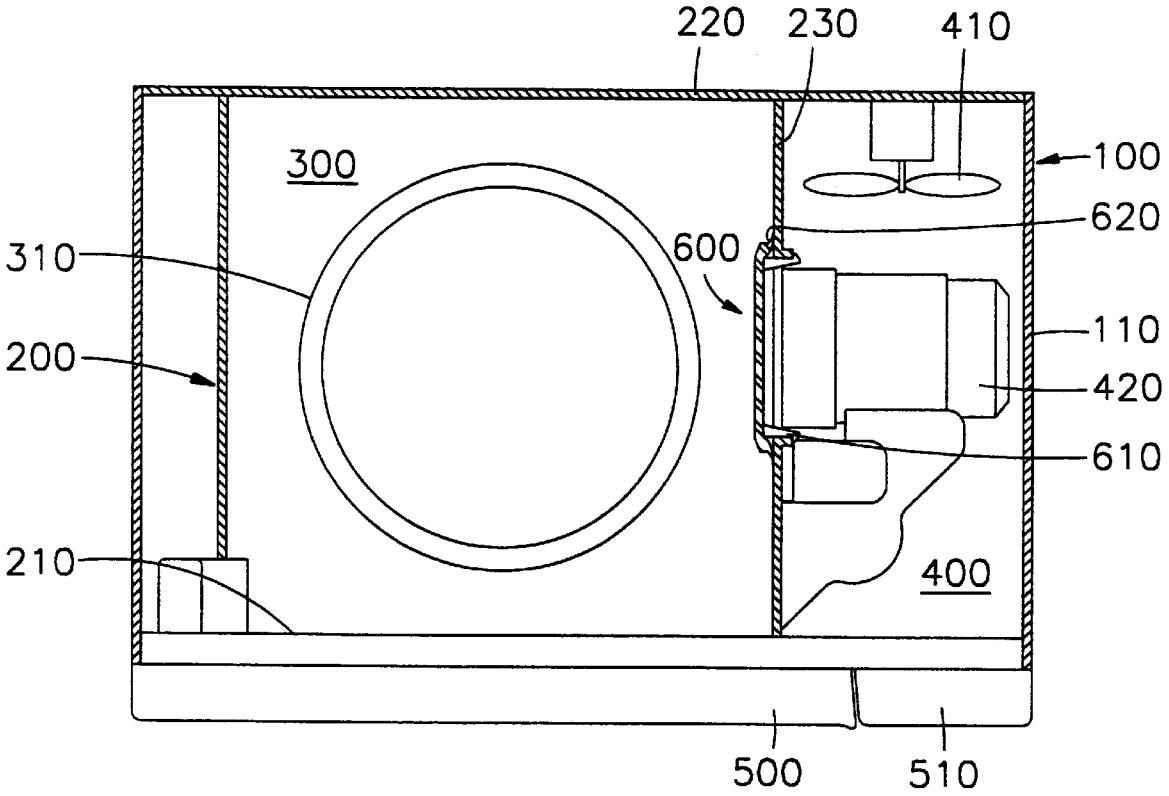
FIG. 1 is a sectional view of the interior structure of a microwave oven in accordance with the present invention.

Preferred embodiments of the present invention will be described in detail with reference to the accompanying drawings. As shown in FIG. 1, a microwave oven of the present invention includes an inner case 200 in which a cooking chamber 300 with an open side is formed, and an outer case 100 connected with the inner case 200 and having an electrical component compartment 400 separated from the cooking chamber 300. The inner case 200 is comprised of a front panel 210, a rear panel 220 and right and left side panels 230, thus constituting the cooking chamber 300, which also has a tray 310 on the bottom. A door 500 is hinged on one side of the front panel 210 to open and close the cooking chamber 300, and operating buttons (not illustrated) and a display (not illustrated) are provided on one side of the front panel 210.

The electrical component compartment 400, in which various electrical components are installed, is positioned between the right side panel 230 of the inner case 200 and the right side 110 of the outer case 100. The electrical component compartment 400 holds a magnetron 420 for emitting microwave energy into the cooking chamber 300, a high voltage transformer (not illustrated), a choke circuit board (not illustrated), and a fan 410 for cooling the electrical components. The right side panel 230 has an opening 231(FIG. 2) through which the cooking chamber 300 is furnished microwaves from the magnetron 420, which is mounted in the electrical component compartment 400 on the right side panel 230.

Figure 2:
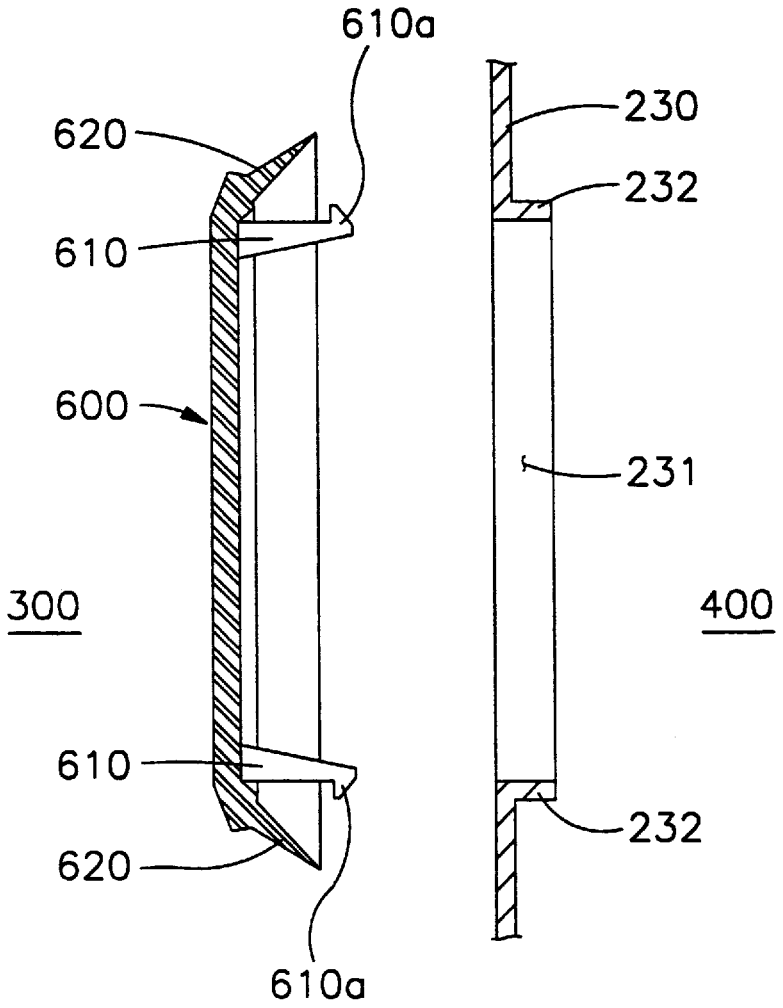
FIG. 2 is an exploded-sectional view showing a part of a cover plate in accordance with the preferred embodiment of the present invention.
Figure 3:
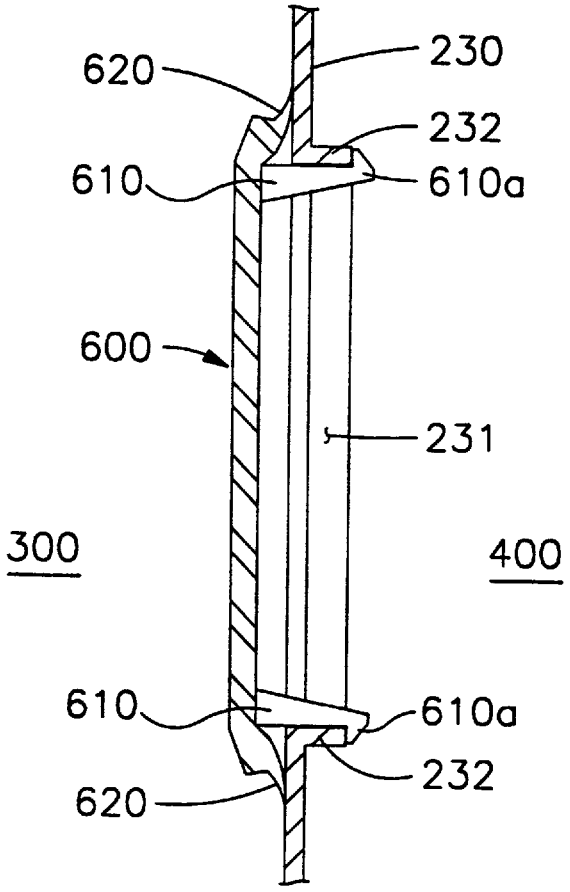
FIG. 3 is a sectional view of the coupling structure of the cover plate in accordance with the present invention.
Figure 4:
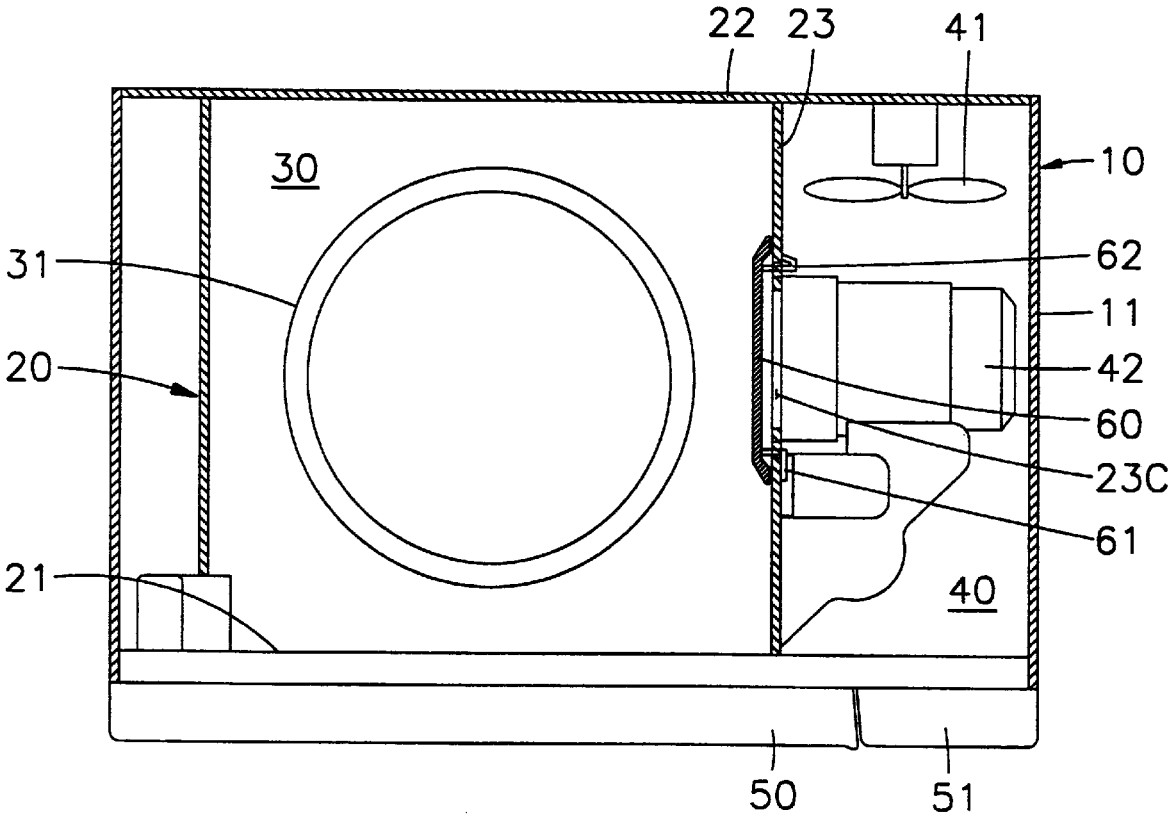
FIG. 4 (PRIOR ART)
FIG. 4 is a sectional view schematically depicting the interior of a conventional microwave oven.
Figure 5:
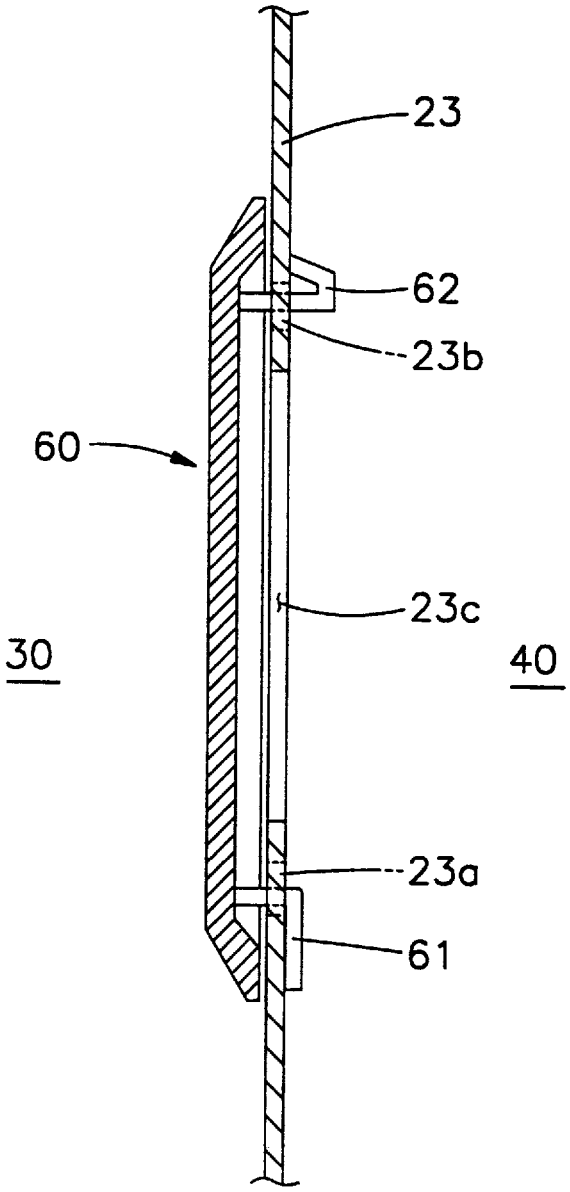
FIG. 5 (PRIOR ART)
FIG. 5 is an enlarged-sectional view of the coupling structure of a cover plate of FIG. 4.

A cover plate 600 is joined to the right side panel 230 on the side of the cooking chamber 300 to cover the opening 231 by the use of coupling means such as curved portions 232 and catches 610, and this coupling structure will be described referring to FIGS. 2 and 3. The curved portion 232 is formed on both the upper and lower edges of the opening 231 by bending the upper and lower edges. This procedure also strengthens the right side panel 230 by increasing its sectional area, thus preventing the region of the side panel 230 around the opening 231 from being deformed. The catches 610 are formed on the back of the cover plate 600, which is made of injection-molded plastic, to catch the curved portions 232 after they pass through the opening 231. Elastic sealing members 620, which taper to a point in a direction toward the side panel, are integrally formed on the outer peripheral edge of the cover plate 600. A hook 610*a* is formed into an outward curve for catching the curved portions 232 on the tip of each catch 610. As shown in FIG. 3, as each hook 610*a* catches the end of the respective curved portion 232 after passing through the opening 231, the flexible sealing members 620 are forcibly pressed against the right side panel 230 and are bent as a result.

When mounting the magnetron 420 on the right side panel 230 or when the cover plate 600 is joined to the right side panel 230, outside force is applied perpendicular to plane of the right side panel 230. The curved portions 232, through their strengthening effect on the right side panel 230, prevent its possible deformation. Even if the right side panel 230 does get distorted, the elastic properties of the flexible sealing members 620 allow them to reconform to the changed surface of the right side panel 230, thus precluding a gap from being created between the right side panel 230 and the cover plate 600.

Once the microwave oven of the present invention goes into action, high frequency energy produced by the magnetron 420 is transmitted to the cooking chamber 300 through the opening 231 and the cover plate 600 so that the microwave oven cooks food contained therein by frictional heat generated by making the molecules of the food being cooked move at high speeds. Since the sealing members 620 of the cover plate 600 lie flush against the right side panel 230 at all times, splattering food does not get between the cover plate 600 and the right side panel 230 during cooking.

As described above, the construction of the present invention prevents the right side panel from being easily distorted. However, if it is, the elasticity of the sealing members allows them to still lie flush against the right side panel at all times, thus preventing the formation of a gap in which dirt and dust can collect and thereby enhancing the reliability of the microwave oven.

What is claimed is:

1. A microwave oven including a housing forming a cooking chamber and an electrical component compartment separated from the cooking chamber by a side panel having an opening to allow the cooking chamber to communicate with the electrical component compartment, a magnetron mounted in the electrical component compartment on the side panel to generate microwave energy to be sent to the cooking chamber through the opening, and a cover plate joined to the side panel, thus covering the opening, curved portions formed on upper and lower edges of the opening and protruding toward the electrical component compartment; and catches formed on the back of the cover plate to catch the curved portions as they pass through the opening, the cover plate being joined to the side panel by the curved portions and catches; the cover plate formed of an elastic material and including an outer peripheral edge in contact with a surface of the side panel facing toward the cooking chamber, the outer peripheral edge being pressed into tight contact with the surface and being bent by such contact.

2. The microwave oven according to claim 1 wherein the outer peripheral edge of the cover plate tapers in a direction toward the surface.

* * * * *